US007565997B1

(12) United States Patent
Lim

(10) Patent No.: US 7,565,997 B1
(45) Date of Patent: Jul. 28, 2009

(54) CLOSABLE FOLDING SERVING COVERED TRAY WITH BEVERAGE HOLDER

(76) Inventor: Edmond Heng Lim, 1745 Walnut St., El Cerrito, CA (US) 94530

( * ) Notice: Subject to any disclaimer, the term of this patent is extended or adjusted under 35 U.S.C. 154(b) by 0 days.

(21) Appl. No.: 12/069,687

(22) Filed: Feb. 11, 2008

(51) Int. Cl.
*B65D 25/04* (2006.01)
*B65D 5/42* (2006.01)

(52) U.S. Cl. ..... 229/120.08; 206/562; 206/565; 229/155; 229/904

(58) Field of Classification Search ..... 229/120.08, 229/155, 904; 206/562, 563, 564, 565; 426/115
See application file for complete search history.

(56) References Cited

U.S. PATENT DOCUMENTS

| | | | | | |
|---|---|---|---|---|---|
| 2,102,009 | A * | 12/1937 | Kondolf | ..... | 229/155 |
| 2,728,484 | A * | 12/1955 | Farrington | ..... | 206/562 |
| 3,319,869 | A * | 5/1967 | Ostwald | ..... | 229/155 |
| 3,640,380 | A * | 2/1972 | Huffman | ..... | 229/904 |
| 4,497,433 | A * | 2/1985 | Wischusen, III | ..... | 206/563 |
| 4,572,423 | A * | 2/1986 | Spencer | ..... | 206/562 |
| 4,969,595 | A * | 11/1990 | Teasdale | ..... | 229/904 |
| 4,981,217 | A * | 1/1991 | Lim | ..... | 206/565 |
| 5,072,877 | A * | 12/1991 | Van Fulpen | ..... | 229/155 |
| 6,129,232 | A * | 10/2000 | Williams | ..... | 229/904 |
| 7,004,314 | B2 * | 2/2006 | Pucillo et al. | ..... | 229/120.08 |
| 7,025,199 | B1 * | 4/2006 | Lim | ..... | 229/904 |
| 7,232,055 | B1 * | 6/2007 | Lim | ..... | 206/565 |
| D567,671 | S * | 4/2008 | Say Ulin | ..... | D9/753 |
| 2007/0074993 | A1 * | 4/2007 | Philips | ..... | 206/562 |

* cited by examiner

*Primary Examiner*—Gary E Elkins
(74) *Attorney, Agent, or Firm*—Risto A. Rinne, Jr.

(57) ABSTRACT

An apparatus for the containment of food items and for the optional transport of various types of beverage containers includes a bottom panel, a first side panel, a second side panel, a third side panel, a fourth side panel, a first top panel, a second top panel, a third top panel, and a fourth top panel that are formed of a single sheet of stock and which, when folded along predetermined crease lines, cooperate to provide a serving tray for the retention of the food items in an interior portion and, if desired, a soda can or other beverage container or object in the interior portion and, if desired, a tapered beverage container can be secured to the apparatus at an exterior location. The apparatus is able to secure certain types of beverage containers thereto while still providing a covering over the food items that are disposed in the interior portion.

9 Claims, 5 Drawing Sheets

CLOSABLE FOLDING SERVING COVERED TRAY WITH BEVERAGE HOLDER

This application is related to currently pending prior patent application Ser. No. 10/997,193, filed by the same inventor on Nov. 24, 2004, entitled "Leak-Proof Folding Serving Tray", and to other prior issued U.S. Pat. Nos. 7,025,199 which issued on Apr. 11, 2006 and 7,232,055 which issued on Jun. 19, 2007 both filed by the same inventor and both titled "Folding Serving Tray". The above-referenced related pending patent application and issued patents are incorporated herein by reference.

BACKGROUND OF THE INVENTION

1. Field of the Invention

The present invention, in general relates to paper plates and, more particularly, a leak-proof serving tray that is formed of flat stock and which assembles into a three-dimensional tray.

Serving trays are well known. Variations include serving trays that are folded from a flat sheet into a substantially three-dimensional structure. Some are shipped as flat stock and assembled during use while other types are assembled during manufacture, stacked on top of each other, and shipped in a ready-to-use manner. Those that are assembled during manufacture typically require gluing or stapling of one member to another member in order to secure the tray in the desired assembled configuration. Such assembly can be performed faster and easier if done by the manufacturer as opposed to the end-user.

These types of serving trays are often used in the food service industry to contain food that is to be consumed. They are typically discarded after a single use.

For example, these prior devices often form a simple tray with vertical sides and open top when folded open. They are used for a variety of purposes, some of which include holding French Fries, hamburgers, hot dogs, and other typical fast food items but not a drink cup or can. They are used in ball parks and by various food vendors.

While useful, there are needs that all known prior types of devices fail to satisfy. For example, the prior known folding serving trays either cannot or have great difficulty simultaneously holding a beverage. This is because a beverage is heavy and the thin cardboard (i.e., fiberboard) used for such construction fails to support the beverage which can tilt and spill as the support fails. A hot beverage that is spilled on a person can cause injury which is a liability risk.

Also, beverages typically come in a variety of differently sized cylindrical containers, for example, soda cans, individual cups, coffee cups, etc. Some of these include a tapered diameter and therefore are substantially frusta-conical in shape. There has been no reliable, safe, and convenient way to securely house a great many of the different sizes and styles of beverage containers.

Additionally, when a beverage is added to a prior art type of serving tray a resultant change in the center of gravity is apt to make the prior art serving tray unstable and likely to tip over.

Additionally, there is a need, at times, to hold upright odd-shaped containers, for example, French-fries or unusually shaped beverage containers and the like so they do not spill. The need to hold an odd-shaped container upright can occur in place of a beverage or along with the need to also secure a beverage.

Another important need relates to leakage. It is preferable to satisfy certain of the above ideals in a container that is also leak-proof for a limited period of time. Food items will spill or splash when carried, regardless of how well a carrying tray secures the items. This is due to the general instability of the human hand. Also, when in crowded areas, for example, at fairs, public gatherings, ball parks, etc., people bump into one-another as a normal course of events. This bumping and jostling can cause the contents in any tray to spill or splash over.

At present, when this happens fluids will leak through the bottom corners and drip on the user, soiling his garments. Almost any fluid can spill. Even ketchup and other more viscous fluids can flow in hot weather or be thinned by other beverages.

If a second beverage is required, it is also desirable to be able to secure the second beverage in the tray.

An especially important need that has not been satisfied with prior art types of serving trays is to be able to transport a beverage and dispose the beverage in or adjacent to the serving tray while, at the same time, providing a covering over any food items that are disposed in the serving tray.

For example, soda cans include a constant outside diameter along their length. They, therefore, cannot be supported by a mere opening that includes a slightly larger diameter than that of the soda can. By way of comparison, a tapered beverage container can be placed in a larger diameter opening into which it will descend and be supported by the structure that surrounds the opening.

Accordingly, in order to support the soda can it must be placed inside the serving tray so that a bottom of the soda can is supported by a bottom panel of the serving tray. To accomplish this, certain of the corner flaps must be left open whenever the soda can is disposed in the serving tray. This permits dirt, dust, and other environmental contaminants to potentially come in contact with the food items that are in the serving tray adjacent to the soda can.

The potential for contamination and illness increases by the use of prior art serving trays in this manner. This can result in physical harm and even in legal action being taken against the company that is serving food in unsealed containers.

Even more so, the general consuming public has long desired to be able to transport a soda can or other type of beverage container while, at the same time, providing a covering over the food items in the serving tray that effectively keeps contaminants from contacting the food items. The general consuming public would feel better about eating their food if they knew it was kept of possible contamination.

Additionally, increasingly strict government regulations by national, state, and local governing bodies are requiring that measures be taken to ensure that food items are not contaminated prior to their consumption.

Accordingly, there exists today a need for a closable serving tray with beverage holder that helps ameliorate the above-mentioned difficulties.

Clearly, such an apparatus would be a useful and desirable device.

2. Description of Prior Art

Paper serving trays are, in general, known. For example, the following patents describe various types of these devices:

U.S. Pat. No. 6,719,192 to Barcat et al., that issued on Apr. 13, 2004;

U.S. Pat. No. 6,422,453 to Wang, that issued on Jul. 23, 2002;

U.S. Pat. No. 5,549,241 to Correll, that issued on Aug. 27, 1996;

U.S. Pat. No. 5,524,814 to Davis, that issued on Jun. 11, 1996;

U.S. Pat. No. 4,981,217 to Lim, that issued on Jan. 1, 1991;

U.S. Pat. No. 4,832,257 to Wood, that issued on May 23, 1989;

U.S. Pat. No. 4,685,583 to Noon, that issued on Aug. 11, 1987;

U.S. Pat. No. 4,364,475 to D'Elia, that issued on Dec. 21, 1982;

U.S. Pat. No. 4,260,098 to Manizza et al., that issued on Apr. 7, 1981;

U.S. Pat. No. 4,114,797 to Manizza, that issued on Sep. 19, 1978;

U.S. Pat. No. 4,055,293 to Stramaglia, that issued on Oct. 25, 1977;

U.S. Pat. No. 4,019,675 to Andersson et al., that issued on Apr. 26, 1977;

U.S. Pat. No. 3,669,340 to Kinney, that issued on Jun. 13, 1972;

U.S. Pat. No. 3,386,644 to Zackheim, that issued on Jun. 4, 1968;

U.S. Pat. No. 3,226,006 to Dunn, that issued on Dec. 28, 1965;

U.S. Pat. No. 2,942,769 to Kuchenbecker, that issued on Jun. 28, 1960;

U.S. Pat. No. 2,719,414 to Davis, that issued on Oct. 4, 1955;

U.S. Pat. No. 2,640,589 to Foster et al., that issued on Jun. 2, 1953;

U.S. Pat. No. 2,485,704 to Cranshaw, that issued on Oct. 25, 1949;

and French Patent Publication No. 2,685,906 to Denis, that was filed on Jan. 7, 1992.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a closable serving tray with beverage holder that is formed out of a flat stock.

It is also an important object of the invention to provide a closable serving tray with beverage holder that is formed from a cardboard.

Another object of the invention is to provide a closable serving tray with beverage holder that is formed from a fiberboard.

Still another object of the invention is to provide a closable serving tray with beverage holder that can be shipped assembled and ready for use.

Still yet another object of the invention is to provide a closable serving tray with beverage holder that can be partially assembled during manufacture, stacked on top of each other, and shipped ready for final assembly and use.

Yet another important object of the invention is to provide a closable serving tray with beverage holder that can be partially fabricated during manufacture and shipped in a partially assembled state.

Still yet another important object of the invention is to provide a closable serving tray with beverage holder that can support a beverage container that is disposed in an interior portion of the serving tray.

A first continuing object of the invention is to provide a closable serving tray with beverage holder that can support a beverage container that is disposed outside of an interior portion of the serving tray.

A second continuing object of the invention is to provide a closable serving tray with beverage holder that can support two beverage containers and wherein the two beverage containers are each disposed in an interior of the serving tray.

A third continuing object of the invention is to provide a closable serving tray with beverage holder that can support two beverage containers and wherein one of the two beverage containers is disposed in an interior of the serving tray and a second of the beverage containers is disposed adjacent to the interior of the serving tray.

A fourth continuing object of the invention is to provide a closable serving tray with beverage holder that is formed of a contiguous sheet of paper, cardboard, or other material.

A fifth continuing object of the invention is to provide a closable serving tray with beverage holder that is economical to manufacture A sixth continuing object of the invention is to provide a closable serving tray with beverage holder that allows placement of a beverage in the same compartment as other food items are placed.

A seventh continuing object of the invention is to provide a closable serving tray with beverage holder that can be die-cut or stamped from single sheet of flat-stock material.

An eighth continuing object of the invention is to provide a closable serving tray with beverage holder that can be die-cut or stamped from single sheet of flat-stock material and which can include all required cuts through the material and all desired creases.

A ninth continuing object of the invention is to provide a closable serving tray with beverage holder that includes a top panel that includes an opening therein that is adjacent to a side panel, and wherein the opening is able to receive a tapered beverage container therein, and wherein the side panel provides mechanical support to the beverage container sufficient to retain the beverage container in a vertical orientation.

A tenth continuing object of the invention is to provide a closable serving tray with beverage holder that includes a first retaining member that is adapted to wrap around a portion of a beverage container that is disposed in an interior portion of the serving tray and wherein the first retaining member includes a first end that is attached to a top panel of the serving tray and a distal second end and wherein a plurality of partial parallel spaced-apart cuts extend along the length of the first retaining member, and wherein each partial cut is adapted to cooperate with a V-shaped notch that is provided in a second retaining member, and wherein the second retaining member includes a first end thereof that is attached to an opposite side of the top panel, and wherein a distal end of the second retaining member is adapted to wrap around a portion of the beverage container and engage with the first retaining member sufficient to retain the beverage container in an upright position.

An eleventh continuing object of the invention is to provide a closable serving tray with beverage holder that includes a top panel that includes an opening therein and wherein the opening includes a circular shape, and wherein the opening is not fully surrounded by the top panel and includes a portion that is open.

A twelfth continuing object of the invention is to provide a closable serving tray with beverage holder that includes a second top panel that includes an opening therein and wherein the opening includes a circular shape, and wherein the opening is not fully surrounded by the second top panel and wherein the opening includes a portion that is open, and which includes a fourth top panel that includes a second opening therein and wherein the second opening in the fourth top panel includes a circular shape, and wherein the second opening is not fully surrounded by the fourth top panel and includes a portion that is open, and wherein when the second top panel and the fourth top panel are folded so that they are disposed over and parallel to a bottom panel of the serving tray, the opening and the second opening align to provide an overall circular opening into which a beverage container can be inserted and wherein a bottom of the beverage container is supported by the bottom panel of the serving tray and wherein the opening and the second opening encircle the beverage container and provide an effective seal surrounding the beverage container and covering over an interior portion of the serving tray sufficient to prevent contamination of food items that are disposed in the interior portion of the serving tray and proximate to the beverage container.

A thirteenth continuing object of the invention is to provide a closable serving tray with beverage holder that includes a first top panel, a second top panel, a third top panel, and a fourth top panel that are able to be folded so that they are disposed over and parallel to a bottom panel of the serving tray, and when so disposed provide a covering that extends fully over a top of the serving tray that is effective at preventing contamination of food items that are disposed in the serving tray.

A fourteenth continuing object of the invention is to provide a closable serving tray with beverage holder that is stable when placed on a level surface.

A fifteenth continuing object of the invention is to provide a closable serving tray with beverage holder that is stable when a tapered beverage container is attached thereto and disposed on an exterior of the serving tray when the serving tray is placed on a level surface.

Briefly, a closable serving tray with beverage holder that is constructed in accordance with the principles of the present invention has a bottom panel, a first side panel, a second side panel, a third side panel, a fourth side panel, a first top panel, a second top panel, a third top panel, and a fourth top panel that are formed of a single sheet of material stock and which, when folded along crease lines, cooperate to retain a beverage container in an interior portion of the serving tray while effectively covering an interior portion of the serving tray and also cooperate to retain a tapered beverage container adjacent to one of the side panels wherein the tapered beverage container is disposed outside of the interior portion, also while effectively providing a covering over the interior portion of the serving tray.

DETAILED DESCRIPTION OF THE INVENTION

Figure 5:
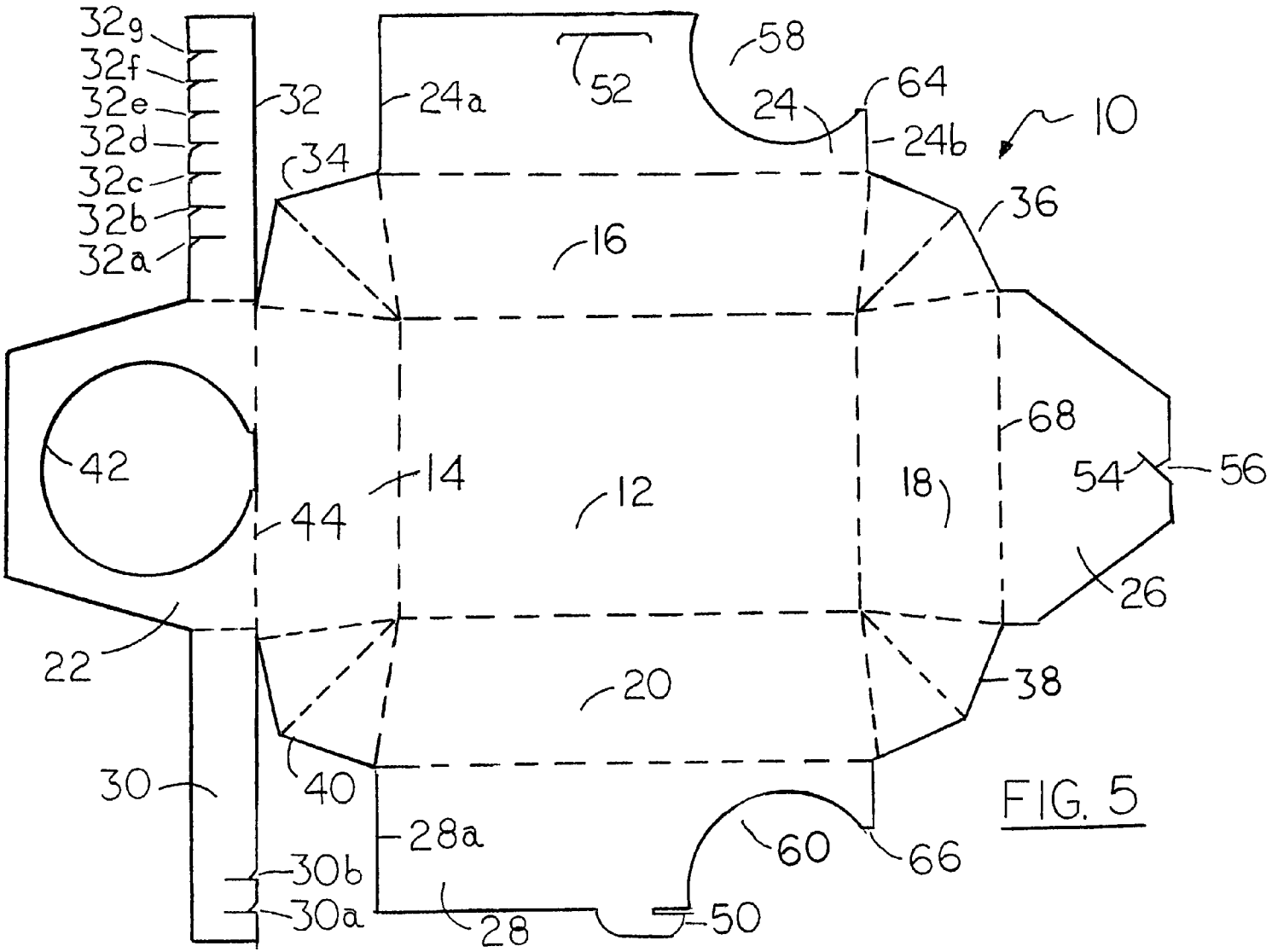
FIG. 5 is a plan view of beverage holder of FIG. 1 after it has been cut and creased in a flat state, prior to assembly.

Referring on occasion to all of the drawing figures and in particular now to FIG. 5 is shown, a closable serving tray with beverage holder, identified in general by the reference numeral 10.

The closable serving tray with beverage holder 10 includes a bottom panel 12, a first side panel 14, a second side panel 16, a third side panel 18, a fourth side panel 20, a first top panel 22, a second top panel 24, a third top panel 26, and a fourth top panel 28 that are formed of a single sheet of material stock such as heavy duty paper or cardboard stock.

An optional first retaining member 30 and second retaining member 32 are included and attached to opposite sides of the first top panel 22.

A first corner 34 is disposed between the first side panel 14 and the second side panel 16. A second corner 36 is disposed between the second side panel 16 and the third side panel 18. A third corner 38 is disposed between the third side panel 18 and the fourth side panel 20. A fourth corner 40 is disposed between the first side panel 14 and the fourth side panel 20.

A variety of crease lines are shown as dashed lines, in FIG. 5 and are impressed into the closable serving tray with beverage holder 10 during manufacture and preferably when it is cut (die-stamped) from the single sheet of material. The crease lines facilitate folding of the various parts of the closable serving tray with beverage holder 10, and are well known generally in the paper serving tray arts.

It is important to note that wherever a crease line is shown (in FIG. 5) that there will be a fold in some direction along each crease line that occurs. A solid line (in FIG. 5) indicates a cut line where a cut has been made through the material that is used to form the closable serving tray with beverage holder 10. Certain of the crease lines and cut lines, when special consideration is needed, are discussed in greater detail hereinafter and are provided with identifying reference numerals.

It is also important to also note that all of the component parts thereof are joined together as shown to provide a contiguous single piece of material from which the closable serving tray with beverage holder 10 is formed. This makes assembly easy and economical to accomplish as it is stamped from a single stock of material.

The closable serving tray with beverage holder 10 is then folded along certain of the crease lines so as to orient the side panels 14, 16, 18, 20 in a generally near vertical orientation with respect to the bottom panel 12.

As the first corner 34, second corner 36, third corner 38, and the fourth corner 40 are folded into the desired shaped they are each glued, stapled, fastened in some other way to a respective one of the side panels 14, 16, 18, 20.

It is noted that side panels 14, 16, 18, 20 are not preferably disposed so that they are truly vertical with respect to the bottom surface 12 as this orientation would prevent the stacking of the partially assembled closable serving tray with beverage holder 10 one atop the other. Rather, each of side panels 14, 16, 18, 20, when assembled, inclines slightly outward and away from the bottom panel 12.

This disposes an upper crease line of each of the side panels 14, 16, 18, 20 (i.e., where a corresponding one of the top panels is attached to one of the side panels 14, 16, 18, 20) outward and away from a vertical plane that aligns with a perimeter edge of the bottom panel 12. The perimeter edge surrounds the bottom panel 12 and extends to the crease lines that also surround the bottom panel 12. Accordingly, a bottom crease line of each of the side panels 14, 16, 18, 20 (i.e., where the corresponding one of the side panels 14, 16, 18, 20 is attached to the bottom panel 12) aligns with the perimeter edge that surrounds the bottom panel 12.

The resultant outward taper of the side panels 14, 16, 18, 20 allows for the stacking of the closable serving tray with beverage holder 10 one atop the other with a bottom panel 12 of each upper one of the closable serving tray with beverage holder 10 resting atop the bottom panel of the closable serving tray with beverage holder 10 that is disposed underneath.

The first top panel 22 includes a first circular opening 42 therein. An inside edge of the first circular opening 42 is disposed adjacent to an upper crease line 44 of the first side panel 14.

Figure 1:
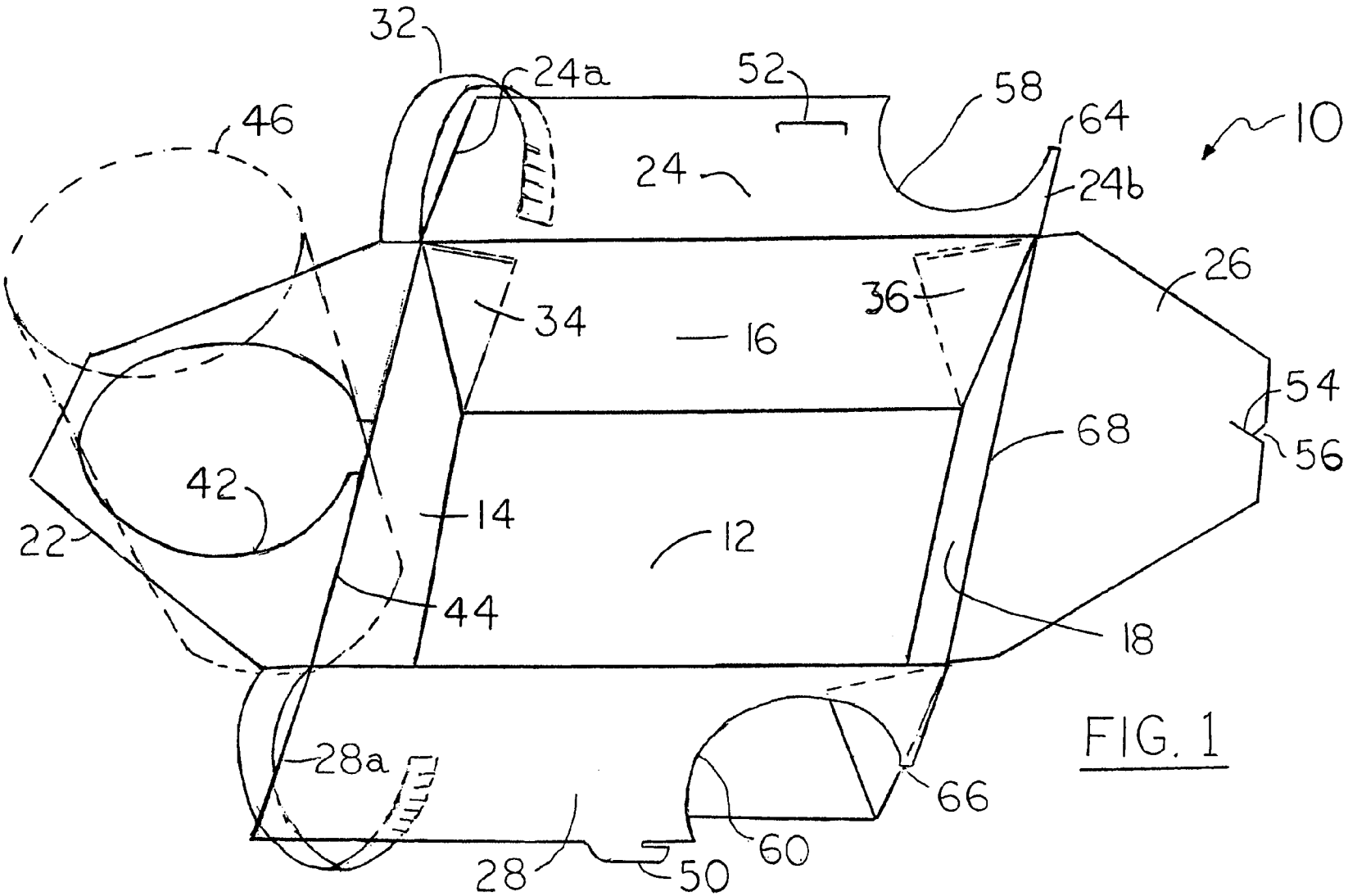
FIG. 1 is a view in perspective of a closable serving tray with beverage holder with all top panels in an open, generally flat position.

Referring now in particular to FIG. 1, the closable serving tray with beverage holder 10 is shown in a partially assembled form with the first corner 34 and the second corner 36 folded adjacent to the second side panel 16 and attached thereto, preferably by an adhesive (glue). Similarly (not shown), the third corner 38 and the fourth corner 40 are also folded and attached to the fourth side panel 20.

The closable serving tray with beverage holder 10 will typically be in the partially assembled state after manufacture. They are stacked on top of each other and shipped to the end-user (i.e., a food service facility/restaurant) in the partially assembled state.

The first top panel 22, as shown in FIG. 1, extends outward, away from an interior portion of the closable serving tray with beverage holder 10. The first top panel 22, as shown in FIG. 1, is generally in parallel planar alignment with respect to the bottom panel 12.

A tapered beverage container, shown in dashed lines and identified by the reference numeral 46, is disposed in the first circular opening 42. The tapered beverage container 46 has descended in the first circular opening 42 until an outside diameter of the tapered beverage container 46 is equal to an inside diameter of the first circular opening 42. At that point an increase in friction retains the tapered beverage container 46 in the first circular opening 42.

For most types of the tapered beverage container 46, a bottom surface of the tapered beverage container 46 will be disposed at nearly the same plane as that of the bottom panel 12 of the closable serving tray with beverage holder 10. This is important.

The tapered beverage container 46 is generally heavy and changes the center of gravity of the closable serving tray with beverage holder 10. If the bottom of the tapered beverage container 46, when inserted in the first circular opening 42, is disposed significantly above the plane of the bottom panel 12 there will be a tendency to tip the closable serving tray with beverage holder 10, possibly spilling the contents when it is placed on a level surface. This tendency is eliminated or greatly reduced by disposing the bottom of the tapered beverage container 46 at or near the plane of the bottom panel 12.

Another important benefit is also provided by disposing the first circular opening 42 so that it is adjacent to the upper crease line 44 of the first side panel 14. When the closable serving tray with beverage holder 10 is suspended in the air the weight of the tapered beverage container 46 will tend to draw the first top panel 22 downward, toward the first side panel 14.

As this happens, the tapered beverage container 46 will come into contact with the outside surface of the first side panel 14. The first side panel 14 provides structural support and stability that prevents further tilting of the first top panel 22 or of the tapered beverage container 46.

Even if the tapered beverage container 46 is filled with fluid and is especially heavy, it is retained in position by its contact with the first side panel 14. By disposing the first circular opening 42 so that it is adjacent to the upper crease line 44 of the first side panel 14, this placement ensures that contact by the first side panel 14 with the tapered beverage container 46 will occur along a line that descends downward on an exterior of the tapered beverage container 46 along the entire portion of the tapered beverage container 46 that is disposed below the first top panel 22. This eliminates pressure points and provides ample support.

With prior art types of serving trays it has heretobefore not been possible to provide adequate support sufficient to retain the tapered beverage container 46 and keep it from tipping over by merely providing an opening (not shown) through a top panel of one of the prior art serving trays. The closable serving tray with beverage holder 10 provides ample support for the tapered beverage container 46 without the need for additional support members or bottom panels to support a bottom of the tapered beverage container 46.

Accordingly, a simpler, less expensive, and more environmentally-friendly solution is provided by the closable serving tray with beverage holder 10 that permits portage of the tapered beverage container 46.

It is also important to note that the tapered beverage container 46 can be supported by the first circular opening 42 of the first top panel 22 and disposed in an exterior of the closable serving tray with beverage holder 10 while food items are disposed in an interior portion of the closable serving tray with beverage holder 10. The interior portion is defined as the volume that exists between the side panels 14, 16, 18, 20 and the bottom panel 12.

Moreover, it is possible to fold the second top panel 24, the third top panel 26, and the fourth top panel 28 inward so that they are disposed over the interior portion and generally parallel with the bottom panel 12.

It is important, also, to note that the second top panel 24 includes a second top panel side 24*a* that extends generally away from the second side panel 16 and that the second top panel side 24*a* is perpendicular with respect to the second side panel 16. Similarly, the fourth top panel 28 includes a fourth top panel side 28*a* that extends generally away from the fourth side panel 20 and that the fourth top panel side 28*a* is perpendicular with respect to the fourth side panel 20.

Prior art design teaching includes a tapered, rather than a perpendicular edge to save material at the location of the second top panel side 24*a* and the fourth top panel side 28*a*. However, with such a prior art type of design, whenever the first top panel 22 is not folded inward, an opening into the interior portion is created.

With the second top panel side 24*a* and the fourth top panel side 28*a* of the closable serving tray with beverage holder 10 it is possible for the first top panel 22 to be disposed in an open position (i.e., not disposed over the interior portion) and still provide a covering over the interior portion.

This is because when the second top panel 24 and the fourth top panel 28 are folded inward, the first top panel side 24*a* and the fourth top panel side 28*a* provide additional or backup coverage in the area that would otherwise have been covered by the first top panel 22.

Figure 2:
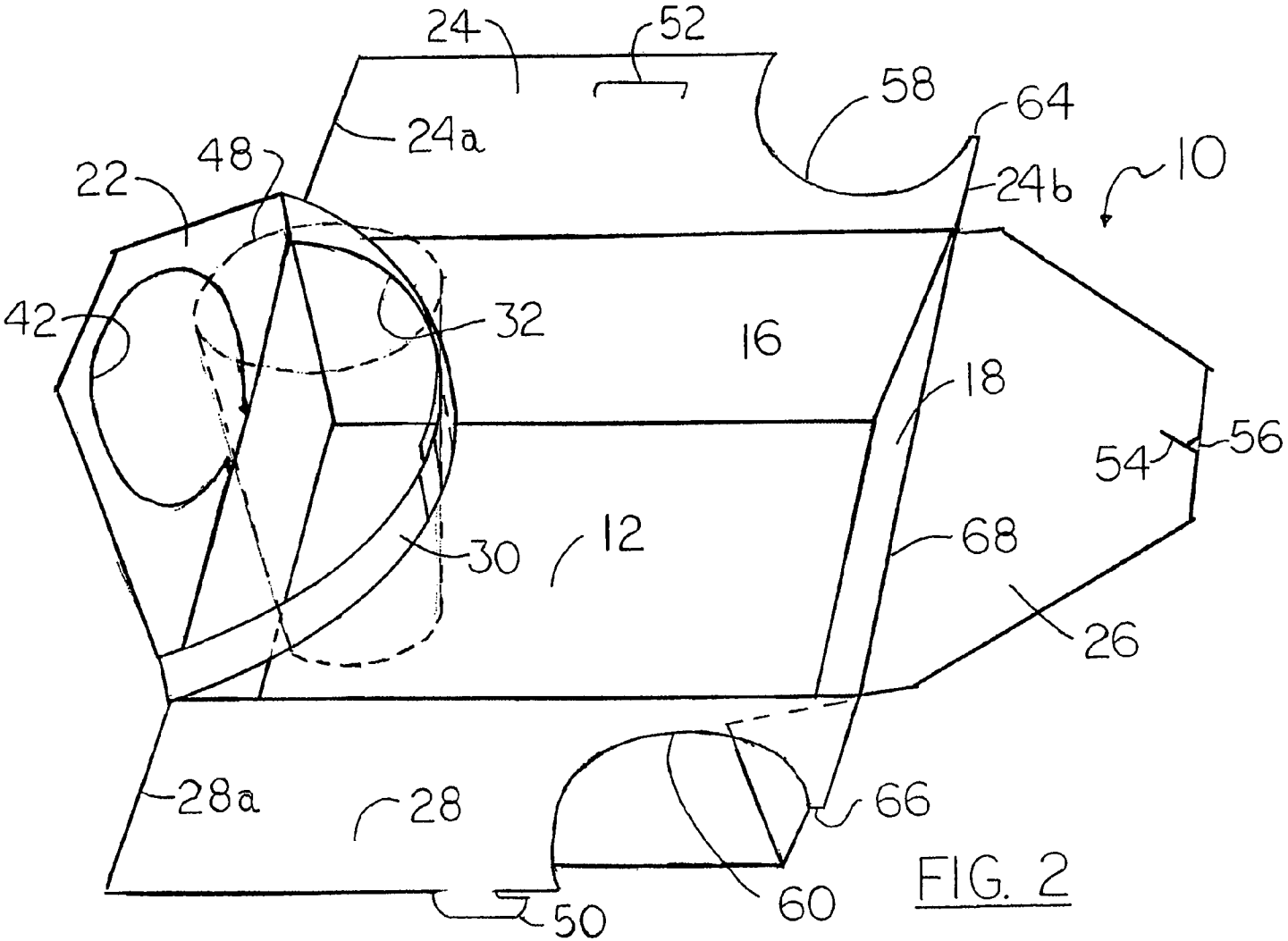
FIG. 2 is a view in perspective of the closable serving tray with beverage holder of FIG. 1 with three of the top panels in an open, generally flat position and one of the top panels in an open and generally vertical position.

Referring now in particular to FIG. 2, the first top panel 22 is disposed so that it is generally vertical (i.e., perpendicular with respect to the plane of the bottom panel 12). An object 48 (shown in dashed lines) is disposed in the interior portion with a bottom of the object 48 resting on the bottom panel 12. The object 48 can include any possible type of beverage container, a bag or box of french-fries, or any other large or unusually shaped container or package. It is possible to include, if desired, the tapered beverage container 46 as the object 48.

The first retaining member 30 and the second retaining member 32 are each urged around the object 48 and into the interior portion where they are joined together by engaging one of the cuts (as shown in FIG. 5) 30*a*, 30*b* of the first retaining member 30 into one of the cuts 32*a*, 32*b*, 32*c*, 32*d*, etc. of the second retaining member 32 to retain the object 48 in position adjacent to the first side panel 14.

Accordingly, it is possible to secure the object 48, including the tapered beverage container 46 or other type of beverage container in the interior portion. However, a disadvantage to doing so occurs if the height of the object 48 exceeds the height of the side panels 14, 16, 18, 20. In that instance, it is no longer possible to dispose the second top panel 24 and the fourth top panel 28 over the interior portion and parallel to the bottom surface 12. Therefore, any food items that are disposed in the interior portion will not be covered and protected from possible contamination from environmental contaminants.

Referring now in particular to FIG. 2, the closable serving tray with beverage holder 10 is shown in the fully assembled position. This occurs when, during use, food items are placed in the interior portion and no beverage container of any type is used with the closable serving tray with beverage holder 10.

After the food items have been placed on the bottom panel 12 (not shown), the first top panel 22 is urged inward over the bottom panel 12. The first retaining member 30 and the second retaining member 32 are each also urged into the interior portion.

If desired, the first retaining member 30 and the second retaining member 32 can be removed from the closable serving tray with beverage holder 10 by tearing the first retaining member 30 and the second retaining member 32 off from the first top panel 22 and prior to an urging of the first top panel 22 inward. It is also possible to manufacture the closable serving tray with beverage holder 10 and omit the first retaining member 30 and the second retaining member 32, if desired.

The third top panel 26 is then similarly urged inward over the bottom panel 12. The second top panel 24 is then similarly urged inward, followed by a similar inward urging of the fourth top panel 28. An end portion of the fourth top panel 28 is disposed over an end portion of the second top panel 24. As the fourth top panel 28 is urged inward a retaining tab 50 of the fourth top panel 28 is urged into a generally U-shaped cut 52 that is provided in the second top panel 24.

The retaining tab 50 cooperates with the U-shaped cut 52 to secure all four of the top panels 22, 24, 26, 28 in a closed position where they are disposed over the bottom panel 12.

If preferred, it is also possible to delay the folding inward of the third top panel 26 until it is a last step. An angular cut 54 that descends from a V-shaped cut 56 into a distal end of the third top panel 26 can be inserted over an edge of the fourth top panel 28, thereby securing the third top panel 26 in the closed position.

The second top panel 24 includes an opening 58 therein that is disposed at a distal side 24*b* of the second top panel 24. The distal side 24*b* of the second top panel 24 is opposite with respect to the second top panel side 24*a*. The opening 58 includes a circular shape that is not fully surrounded by the second top panel 24. The opening 58 includes a portion that is open. The portion of the opening 58 that is surrounded by the second top panel 24 resembles approximately two-thirds to three-quarters of a complete circle.

The fourth top panel 28 includes a second opening 60 therein that is disposed at a distal side 28*b* of the fourth top panel 28. The distal side 28*b* of the fourth top panel 28 is opposite with respect to the fourth top panel side 28*a*. The second opening 60 includes a circular shape that is not fully surrounded by the fourth top panel 28. The second opening 60 includes a portion that is open. The portion of the second opening 60 that is surrounded by the fourth top panel 28 resembles approximately two-thirds to three-quarters of a complete circle.

The opening 58 and the second opening 60 are of nearly identical size and mirror each other in shape and position with respect to a center of the bottom panel 12.

Figure 3:
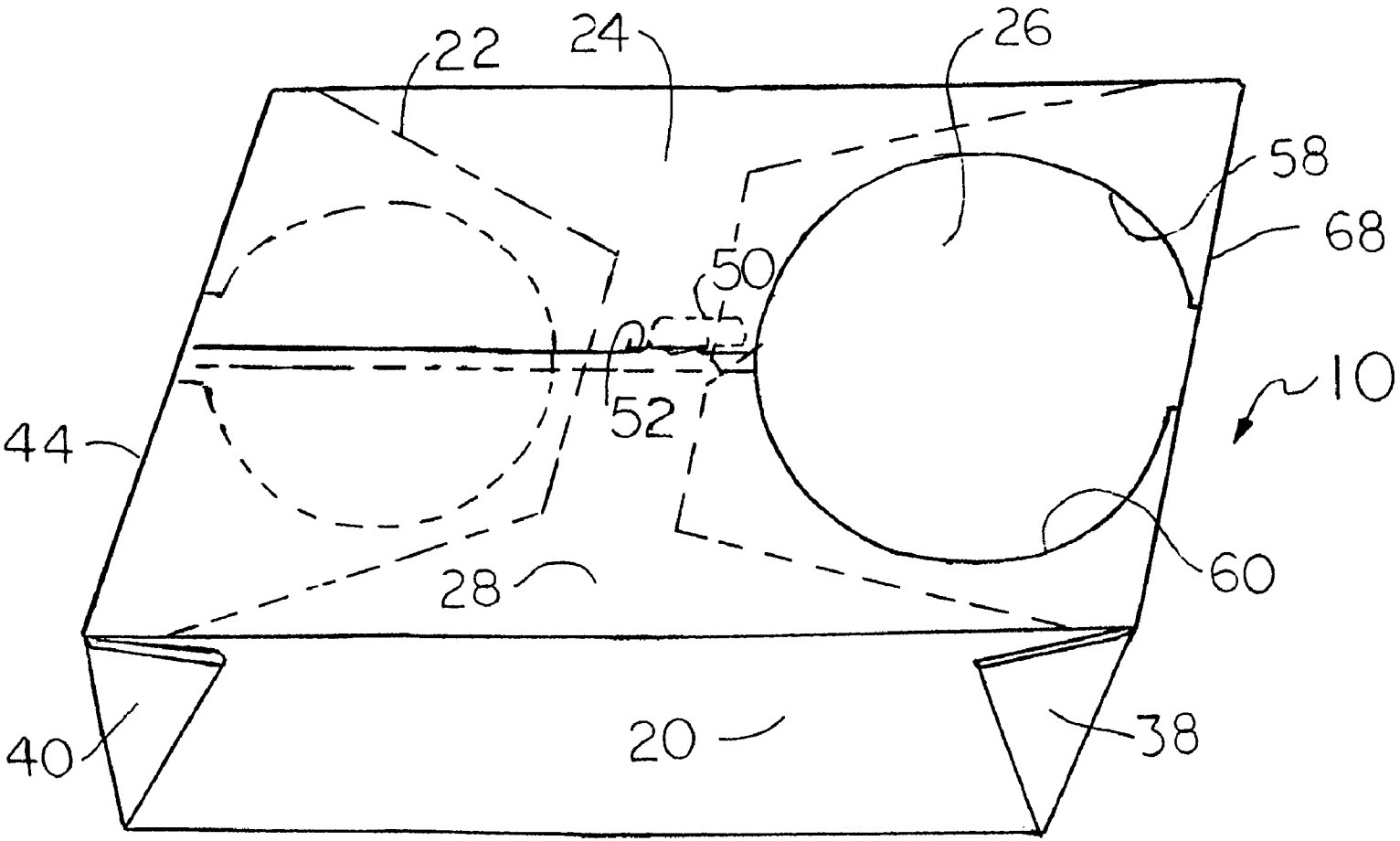
FIG. 3 is a view in perspective of the closable serving tray with beverage holder of FIG. 1 with all four of the top panels in a closed generally flat position.

When the second top panel 24 and the fourth top panel 28 are folded inward, as shown in FIG. 3, the opening 58 and the second opening 60 cooperate to provide generally circular shaped overall opening. In FIG. 3, the overall opening is disposed above the third top panel 26 and is thereby obstructed. Accordingly, the interior portion is fully covered when the closable serving tray with beverage holder 10 is disposed in the fully assembled position.

It is to be noted that all subsequent assembly of the closable serving tray with beverage holder 10 beyond the level of partial assembly that is accomplished by the manufacturer is accomplished by the end user (i.e., the food server). Depending on whether or not the tapered beverage container 46 (or the object 48) is included by the end user will determine the exact degree of subsequent assembly that is to occur.

As the closable serving tray with beverage holder 10 is versatile enough to accommodate various needs multiple configurations are possible. Accordingly, the closable serving tray with beverage holder 10 is used and provided to customers in any of a variety of possible assembled configurations.

Figure 4:
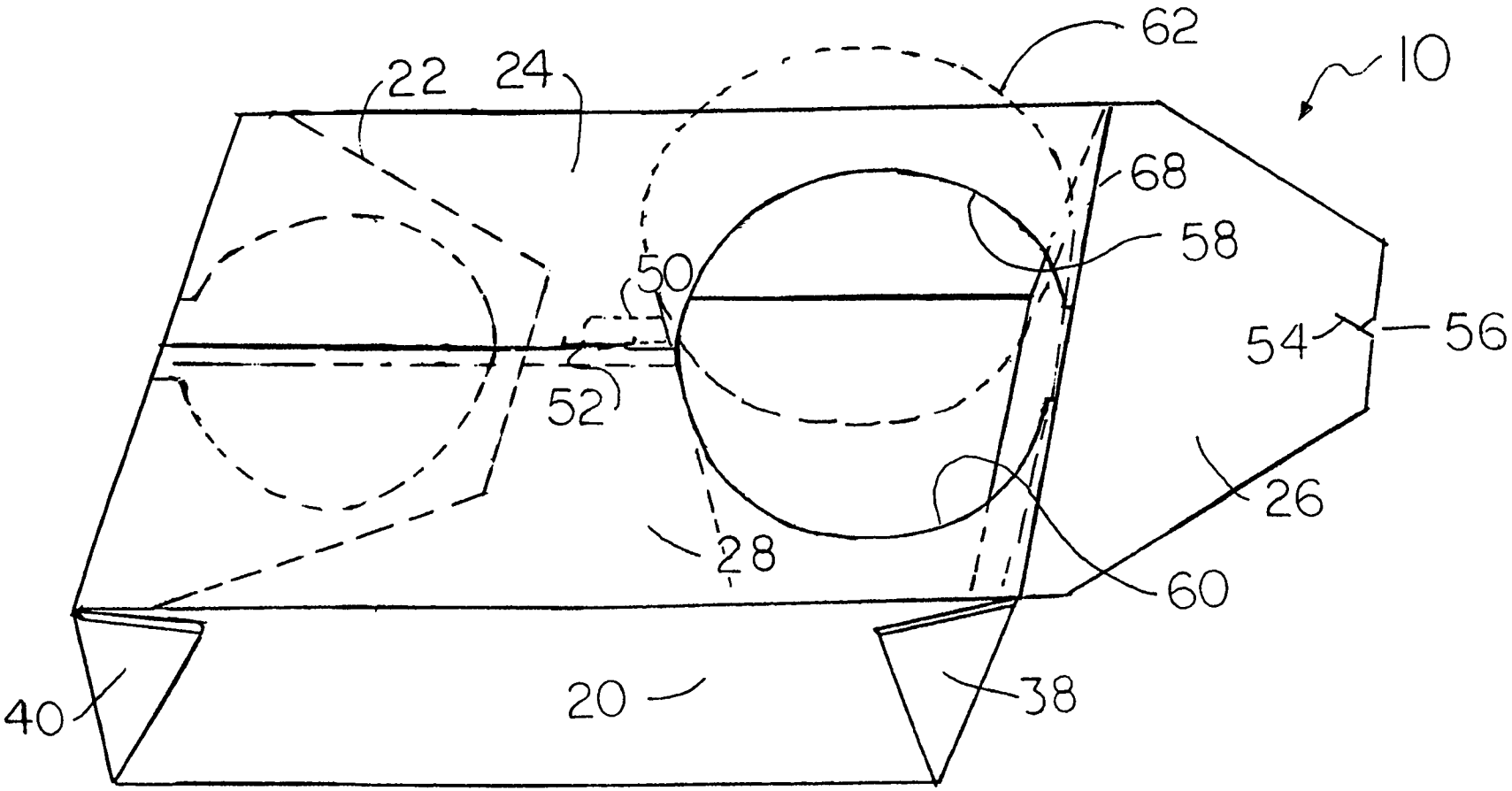
FIG. 4 is a view in perspective of the closable serving tray with beverage holder of FIG. 1 with three of the top panels in a closed generally flat position and one of the top panels in an open position.

Referring now in particular to FIG. 4, the closable serving tray with beverage holder 10 is shown in an alternate assembled configuration ready for use by the customer. In this alternate configuration, the third top panel 26 is not urged inward but rather is disposed away from the interior portion. The circular overall opening provided by the overlapping of the second opening 60 over the first opening 58 is slightly larger than the diameter of a soda can 62 (shown in dashed lines).

Accordingly, a bottom of the soda can 62 rests on the bottom panel 12 while a top of the soda can 62 is disposed above the circular overall opening (i.e., above the plane of the first top panel 22, the second top panel 24, and the fourth top panel 28).

When the first top panel 22, the second top panel 24, and the fourth top panel 28 are closed as shown in FIG. 4 and the soda can 62 is also disposed as shown through the circular overall opening provided by the first opening 58 and the second opening 60, the overall opening provides an effective seal around the soda can 62 and the remainder of the first top panel 22, the second top panel 24, and the fourth top panel 28 provide an effective covering over the interior portion to protect any food items that are disposed in the interior portion of the closable serving tray with beverage holder 10.

In this manner the closable serving tray with beverage holder 10 is able to contain, as a preferred type of the beverage container, the soda can 62 while still ensuring that food items contained in the interior portion are protected from contamination by outside contaminants.

It is important to note that the soda can 62, unlike the tapered beverage container 46, is cylindrical in shape and therefore cannot be effectively retained by friction arising from its insertion through the first circular opening 42, regardless of the diameter of the first circular opening 42. Rather, the soda can 62 must be supported from the bottom.

The user can place the closable serving tray with beverage holder 10 with the soda can 62 and food items disposed therein on any flat surface for convenient use. An example of an acceptable flat surface includes placing the closable serving tray with beverage holder 10 on a lawn. In this way the closable serving tray with beverage holder 10 is ideal for use at picnics and other social gatherings where food and beverages are served.

It is noted that the first opening 58 includes a first short cut line 64 that extends inward from the distal side 24*b* of the second top panel 24 and is perpendicular with respect to the distal side 24*b* of the second top panel 24. The second opening 60 similarly includes a second short cut line 66 that extends inward from the distal side 28*b* of the fourth top panel 28 and is perpendicular with respect to the distal side 28*b* of the fourth top panel 28.

The magnitude of the first short cut line 64 and the second short cut line 66 is equal to the amount that an upper crease line 68 of the third side panel 18 is offset outward with respect to the crease line between the bottom panel 12 and the third side panel 18. This ensures that an edge of the circular overall opening that is disposed closest to the third side panel 18 will align vertically with the crease line between the bottom panel 12 and the third side panel 18.

This, in turn, ensures that a bottom of the soda can 62, when inserted in the circular overall opening, will rest on the bottom panel 12 and not, instead, contact the third side panel 18 before descending onto the bottom panel 12.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improvement to a serving tray of the type made from a single sheet of material that is folded and secured into a partially assembled position ready for use, wherein the improvement comprises:

a bottom panel;

four generally upright side panels disposed around the bottom panel that form a three-dimensional interior portion compartment over said bottom panel, and wherein said four generally upright wall side panels include a first side panel, a second side panel, a third side panel and a fourth side panel that are each attached to said bottom panel, said second side panel opposing said fourth side panel;

a first top panel attached to said first side panel, a second top panel attached to said second side panel, a third top panel attached to said third side panel, a fourth top panel attached to said fourth side panel; and means for securing a beverage container to said serving tray with the beverage container disposed either interiorly or exteriorly of the interior portion compartment, said means for securing comprising a circular overall opening that is provided through said second top panel and said fourth top panel formed by a first partial opening disposed in the said second top panel and a second partial opening disposed in said fourth top panel, said means for securing further comprising a circular top opening in said first top panel disposed adjacent to a crease between said first top panel and said first side panel; wherein when said beverage container is disposed in said interior portion, said third top panel is not folded inward and said second and fourth top panels are disposed over and generally parallel to said bottom panel and combining to provide a covering over all the interior portion except for said circular overall opening which is adapted to receive said beverage container therein; and when said beverage container is disposed exteriorly of said interior portion compartment, said first top panel is folded outward and away from said bottom panel and receives said beverage container within said circular top opening in said first top panel, and said second top panel, third top panel and fourth top panel are folded inward and combine to provide a covering over all of said interior portion compartment with said third top panel covering said circular overall opening to protect any food items placed on the bottom panel.

2. The improved serving tray of claim 1 wherein said beverage container includes a tapered beverage container with a bottom of the tapered beverage container having a first outside diameter and a top of the tapered beverage container having a second outside diameter, said first outside diameter is less than said second outside diameter, said circular top opening in said first top panel having an inside diameter which is greater than said first outside diameter of said beverage container and less than said second outside diameter of said beverage container, and wherein when said beverage container is disposed exteriorly of said tray, said tapered beverage container is urged by gravity through said circular opening until said inside diameter of said circular top opening is equal to an intermediate outside diameter of said beverage container, and when said beverage container is fully disposed within said circular top opening, an exterior of said beverage container is disposed adjacent to said first side panel.

3. The improved serving tray of claim 1 wherein said first partial opening is not a full circle and said second partial opening is not a full circle, and wherein when said second top panel and said fourth top panel are disposed over said bottom panel and parallel with respect thereto, said overall circular opening provides a covering that extends around said beverage container sufficient to retard the entry of outside contaminants into said interior portion.

4. The improved serving tray of claim 1 wherein said beverage container includes a soda can, and wherein said soda can includes a generally cylindrical shape thereto.

5. The improved serving tray of claim 1 wherein said second top panel includes a second top panel side that, when said second top panel is parallel with respect to said bottom panel, said second top panel side is perpendicular with respect to said second side panel.

6. The improved serving tray of claim 1 wherein said fourth top panel includes a fourth top panel side that, when said fourth top panel is parallel with respect to said bottom panel, said fourth top panel side is perpendicular with respect to said fourth side panel.

7. The improved serving tray of claim 1 including means for retaining said second top panel and said fourth top panel over said interior portion.

8. The improved serving tray of claim 7 wherein said means for retaining includes a generally U-shaped cut in said second top panel and a retaining tab in said fourth top panel, and wherein when said second top panel and said fourth top panel are disposed over said interior portion, said retaining tab is able to enter into said U-shaped cut sufficient to secure said fourth top panel to said second top panel.

9. The improved serving tray of claim 1 wherein said third top panel includes an angular cut and wherein said angular cut is adapted to engage with an edge of said fourth top panel sufficient to retain said third top panel to said fourth top panel when said fourth top panel and said third top panel are disposed over said interior portion.

* * * * *